US010308061B2

(12) United States Patent
Maddrell et al.

(10) Patent No.: US 10,308,061 B2
(45) Date of Patent: Jun. 4, 2019

(54) BOOK WITH GREETING CARD COVER

(71) Applicants: Richard G. Maddrell, Barrington, IL (US); Angela M. Hodges, Oak Park, IL (US)

(72) Inventors: Richard G. Maddrell, Barrington, IL (US); Angela M. Hodges, Oak Park, IL (US)

(73) Assignee: COTTAGE DOOR PRESS, LLC, Barrington, IL (US)

( * ) Notice: Subject to any disclaimer, the term of this patent is extended or adjusted under 35 U.S.C. 154(b) by 186 days.

(21) Appl. No.: 14/984,134

(22) Filed: Dec. 30, 2015

(65) Prior Publication Data

US 2016/0236502 A1 Aug. 18, 2016

Related U.S. Application Data

(60) Provisional application No. 62/116,180, filed on Feb. 13, 2015.

(51) Int. Cl.

| | |
|---|---|
| ***B42D 3/00*** | (2006.01) |
| ***B42D 3/06*** | (2006.01) |
| ***B42D 3/08*** | (2006.01) |
| ***B42D 1/00*** | (2006.01) |
| ***B42D 3/12*** | (2006.01) |
| ***B42D 15/02*** | (2006.01) |

(52) U.S. Cl.
CPC ..... *B42D 1/007* (2013.01); *B42D 3/00* (2013.01); *B42D 3/06* (2013.01); *B42D 3/08* (2013.01); *B42D 3/12* (2013.01); *B42D 15/027* (2013.01)

(58) Field of Classification Search
CPC ..... B42D 3/00; B42D 3/08; B42D 3/06
USPC ..... 281/29
See application file for complete search history.

(56) References Cited

U.S. PATENT DOCUMENTS

| | | | | |
|---|---|---|---|---|
| 5,257,823 | A | 11/1993 | Colvin, Jr. et al. | |
| 6,951,352 | B1 * | 10/2005 | Hyde | B42D 1/003 281/15.1 |
| 7,137,752 | B2 * | 11/2006 | Hendee | B42D 3/04 281/31 |
| 8,341,862 | B1 | 1/2013 | Gunther | |
| 8,661,719 | B2 | 3/2014 | Hughes et al. | |
| 2004/0012190 | A1 | 1/2004 | D'Andrea | |

* cited by examiner

*Primary Examiner* — Kyle R Grabowski
(74) *Attorney, Agent, or Firm* — Pauley Erickson & Kottis

(57) ABSTRACT

A greeting card book having at least one page permanently connected to or attached with a greeting card, such as a greeting card cover of the book. The greeting card cover has a surface that displays a message. A flap or other suitable structural device can be used or operated between a closed position and an open position to at least partially hide or reveal the message.

20 Claims, 3 Drawing Sheets

BOOK WITH GREETING CARD COVER

CROSS REFERENCE TO RELATED APPLICATION

This Patent Application claims the benefit of U.S. Provisional Application, Ser. No. 62/116,180, filed on 13 Feb. 2015. The Provisional Patent Application is hereby incorporated by reference herein in its entirety and is made a part hereof, including but not limited to the following.

FIELD OF THE INVENTION

This invention relates to a book having a cover movable with respect to a body of the book, to expose a writing surface and/or another suitable printable surface, displayable surface and/or other surface that can be used to write and/or otherwise display information, such as greeting information.

SUMMARY OF THE INVENTION

The book and cover of this invention can be combined into a fully functional book and also a greeting card, such as a birthday card, a shower card, a graduation card, a sympathy card and/or any other suitable card or other similar apparatus or device for conveying and/or displaying information, including but not limited to text and/or images, for example, which can be used to convey a message. The book and cover of this invention can be used, for example, to combine a book gift with a greeting card, to eliminate the need to buy a greeting card and a separate gift, such as a separate book. The combined book and greeting card of this invention can be used to keep or maintain the communicated message as part of the gift, such as the book, so that in the future when reading the book the communicated message or greeting card is always accessible as an integral part of the book.

The cover, such as the greeting card cover, of this invention can be added to or used with many different conventional books, such as books having conventional board pages, paper pages, fabric pages and/or any other suitable material pages known to those skilled in the art of publishing and printing. In some embodiments of this invention, the cover and the book pages are bound or otherwise connected or integrated together. In other embodiments of this invention, the cover, such as a greeting card cover, can be added or retrofitted to an existing book, for example, to convert the existing book into a combined book and greeting card cover.

BRIEF DESCRIPTION OF THE DRAWINGS

Features of this invention can be better understood when this specification is read or taken in view of the drawings, wherein.

DESCRIPTION OF THE INVENTION

Figure 1:
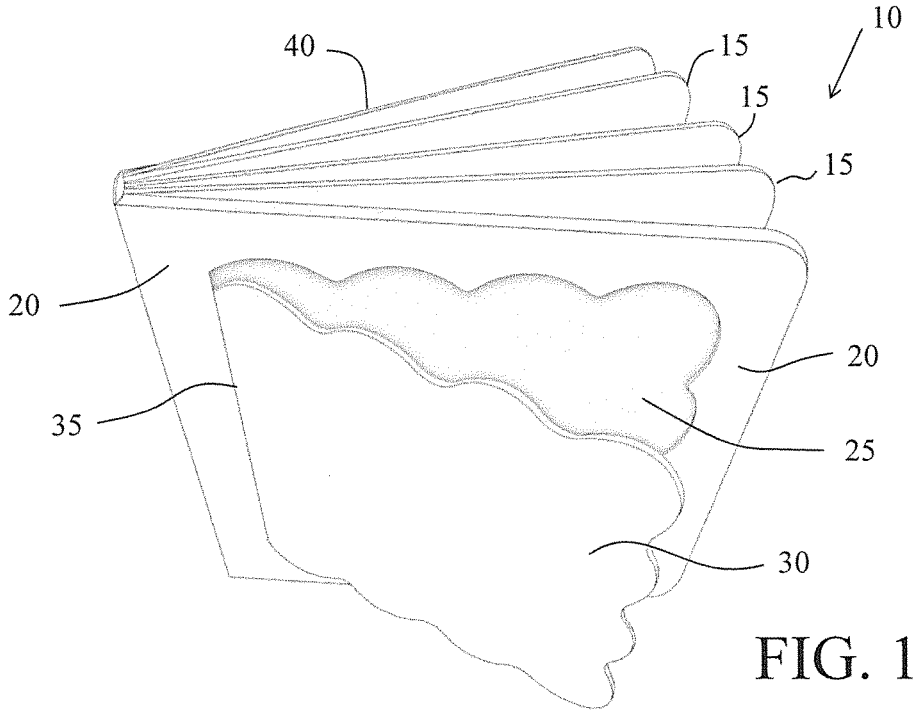
FIG. 1 is a top front perspective view of a book with a greeting card cover, according to one embodiment of this invention.
Figure 2:
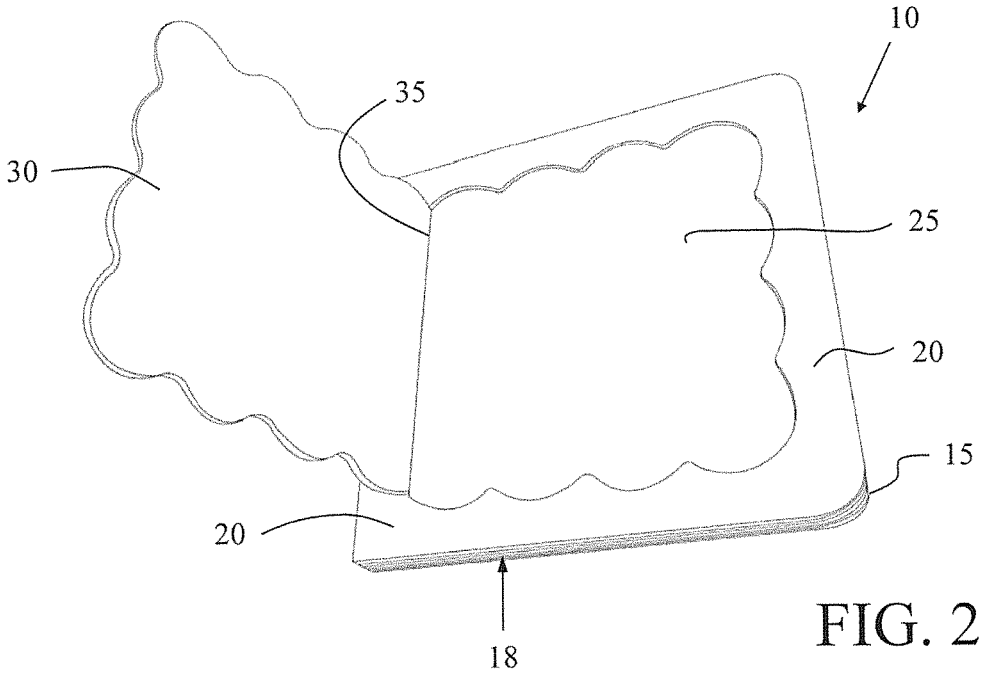
FIG. 2 is a bottom front perspective view of the book with a greeting card cover, as shown in FIG. 1 but with a flap of the cover in a different position.

FIGS. 1 and 2 show front perspective views of book 10 with cover 20, such as a greeting card cover, according to one embodiment of this invention. As shown in FIGS. 1-8, book 10 has a generally rectangular or square overall shape of the periphery of book 10. In other embodiments of this invention, book 10 can have any other suitable overall shape. As shown in FIG. 1, book 10 has a plurality of individual pages 15. In other embodiments of this invention, book 10 can have a single page 15 or a different number of multiple pages.

Each page 15 can be bound by any suitable binding structure and/or binding method known to those skilled in the art of publishing and printing. In some embodiments of this invention, pages 15 are bound so that they can open with respect to each other to show or reveal content on the different pages 15. As shown in FIGS. 1 and 6-8, each page 15 is relatively thick, which is commonly found in books for children. In other embodiments of this invention, page 15 can have any other suitable thickness, depending upon the particular use for book 10. Each page 15 can be constructed of paper, cardboard, polymeric material, fabric material and/or any other suitable material for book 10.

Each page 15 can have a similar overall or peripheral shape to the overall or peripheral shape of cover 20, or can have a different overall or peripheral shape. In some embodiments of this invention, the thickness of cover 20 is approximately the same as the thickness of each page 15, but in other embodiments of this invention the thickness of cover 20 and/or of back 40 can be different.

As shown between FIGS. 1 and 2, cover 20 comprises or includes flap 30 which is movable with respect to cover 20 and/or with respect to body 18 of book 10. FIG. 1 shows flap 30 opened at a first distance from cover 20 which is relatively closer than a second distance shown in FIG. 2 between flap 30 and cover 20. In moving from the position shown in FIG. 1 to the position shown in FIG. 2, flap 30 opens with respect to cover 20. In some embodiments of this invention, flap 30 opens with respect to cover 20 to expose or reveal all or at least a portion of message surface 25 which is attached to, connected with and/or integrated with cover 20.

Figure 3:
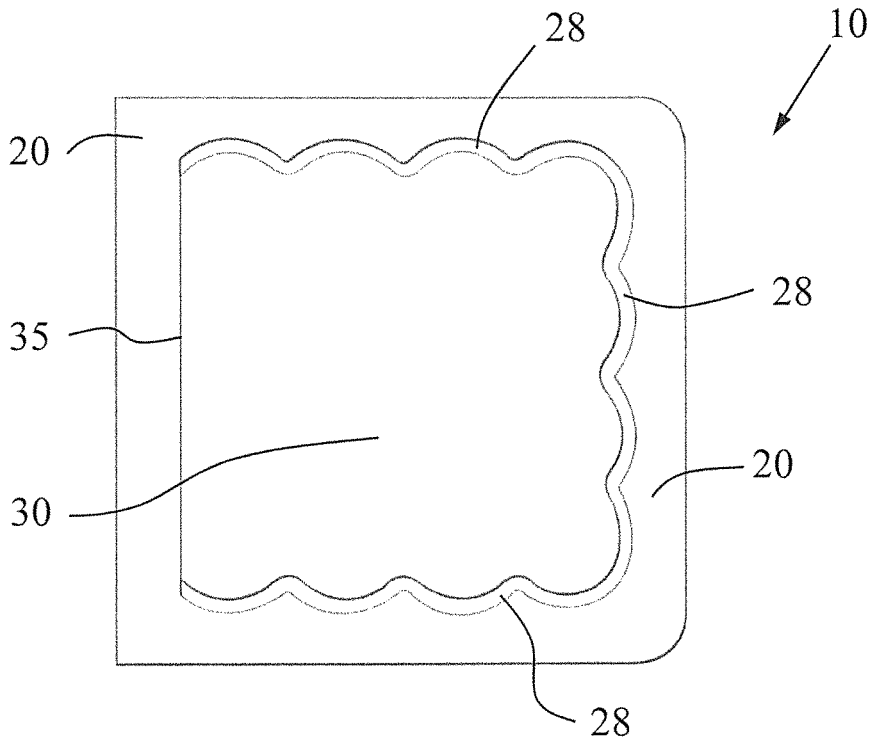
FIG. 3 is a front view of the book with a greeting card cover, as shown in FIG. 1.
Figure 4:
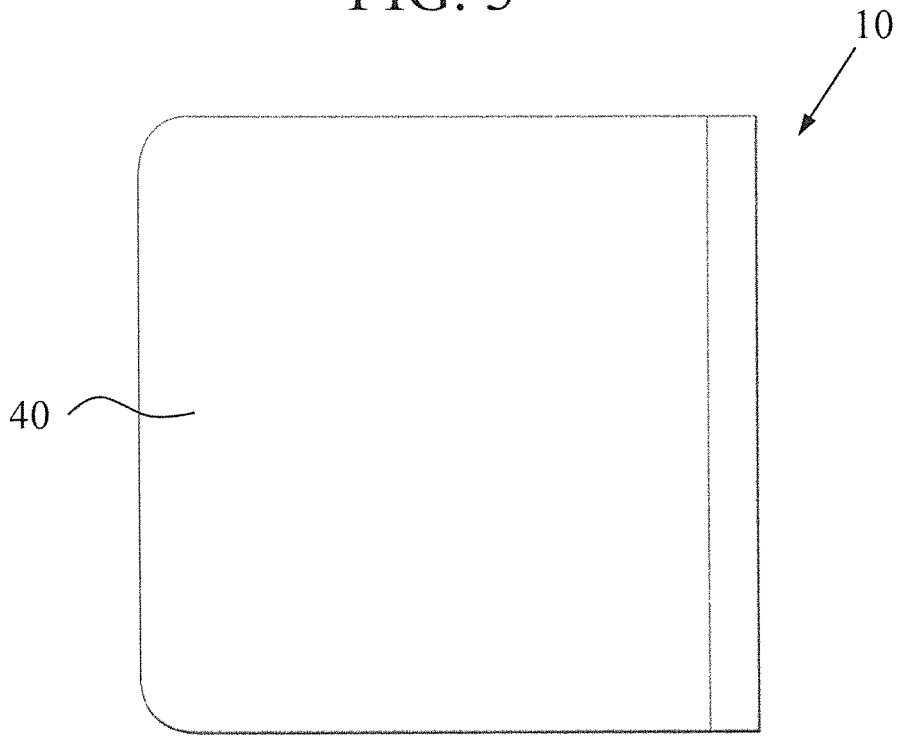
FIG. 4 is a rear view of the book with a greeting card cover, as shown in FIG. 1.
Figure 5:
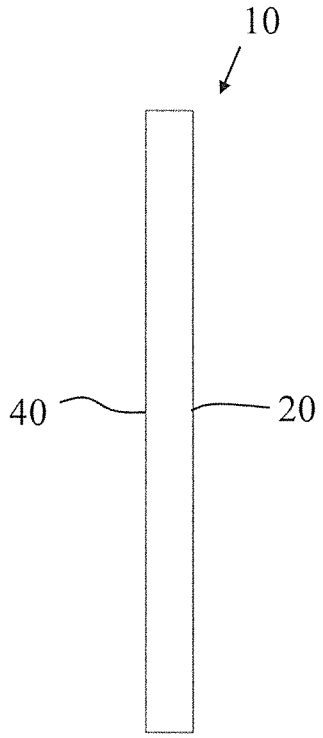
FIG. 5 is a side view of the book with a greeting card cover, as shown in FIG. 1.
Figure 6:
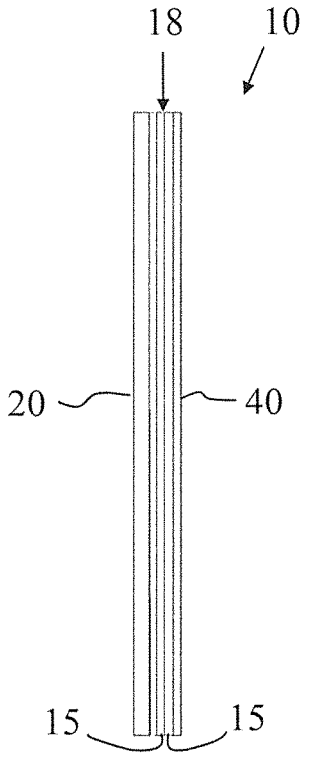
FIG. 6 is a side view, opposite the side view shown in FIG. 5, of the book with a greeting card cover, as shown in FIG. 1.
Figure 7:
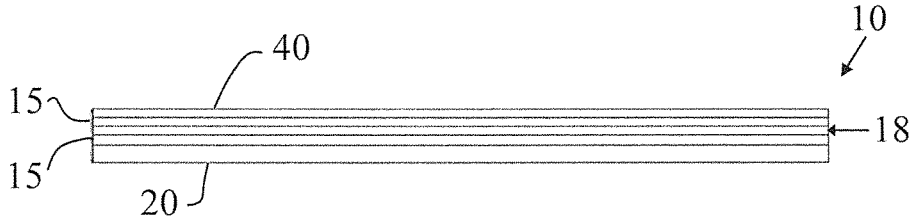
FIG. 7 is a top view of the book with a greeting card cover, as shown in FIG. 1.
Figure 8:
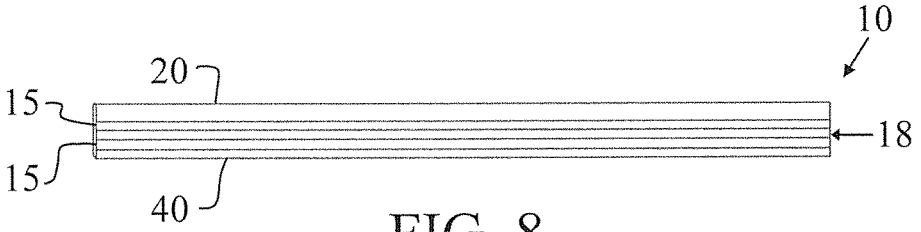
FIG. 8 is a bottom view of the book with a greeting card cover, as shown in FIG. 1.

As shown in FIGS. 1-3, hinge 35 is used to movably connect or attach flap 30 with respect to cover 20. In other embodiments of this invention, any other suitable hinge element, hinge structure and/or structure, such as known to those skilled in the art of publishing and printing, that allows movement of flap 30 with respect to cover 20 can be used in addition to or in lieu of hinge 35 as shown in FIGS. 1-3. In other embodiments of this invention, flap 30 can be movably mounted with respect to cover 20 in a sliding manner and/or in any other suitable structural arrangement that allows movement of flap 30 with respect to cover 20.

In some embodiments of this invention, a magnet, which is not shown in the drawings, can be used to secure flap 30 with respect to cover 20, for example in the position as shown in FIGS. 3 and 5-8, so that flap 30 does not inadvertently move with respect to cover 20. In some embodiments of this invention, an adhesive material, such as fugitive glue or another suitable low-tack adhesive, can be used to secure flap 30 with respect to cover 20, for similar reasons. In other embodiments of this invention, any other suitable material and/or structural element, including but not limited to hook-and-loop fasteners, can be used to secure flap 30 with respect to cover 20, again for similar reasons.

As shown in FIG. 3, at least a portion of a gap, a void or a space between flap 30 and cover 20 forms channel 28. In some embodiments of this invention, channel 28 is formed by a channel cut between flap 30 and cover 20. Channel 28 can have any suitable shape, dimension and/or thickness. In some embodiments of this invention, a dimension of channel 28 is relatively large and thus allows flap 30 to move relatively easily with respect to cover 20. In other embodiments of this invention, all or at least a portion of channel 28 can have a relatively small dimension which can make it more difficult to open flap 30 with respect to cover 20. In still other embodiments of this invention, all or at least a portion of channel 28 forms an interference fit between flap 30 and cover 20, for example, so that a fictional fit between flap 30 and cover 20 can be used to maintain flap 30 in a closed position with respect to cover 20.

As shown in FIGS. 3 and 5-8, flap 30 is in a closed position with respect to cover 20 when flap 30 is secured with respect to cover 20. In the closed position, flap 30 can cover all or at least a portion of message surface 25, which in some embodiments of this invention relates to or corresponds to a greeting card which is in a closed position. Some embodiments of this invention, which allow flap 30 to be secured with respect to cover 20, allow a message written on message surface 25 to be hidden from outer view until flap 30 is moved with respect to cover 20 into an open position which reveals all or at least a portion of message surface 25.

In some embodiments of this invention, message surface 25 comprises or includes all or at least a portion of message surface 25 having a face surface that accepts or accommodates written text or any other suitably applied message or signal. For example, message surface 25 can be structured to accept pencil lead, pen ink, crayons, chalk and/or any other suitable material used to print, write and/or otherwise suitably transfer a message into a visual format. In some embodiments of this invention, message surface 25 comprises paper, cardboard and/or any other suitably durable material. Message surface 25 may or may not have preprinted subject matter, for example, text and/or images conveying a greeting or another suitable message, such as similar to a conventional birthday card.

In some embodiments of this invention, cover 20, back 40 and/or any page 15 comprises or includes at least a portion of the corresponding face surface to have glitter, foil and/or any other suitable art and/or visual material applied and/or fixed with respect to cover 20, back 40 and/or any page 15.

In some embodiments of this invention, although not shown in the drawings, book 10 including cover 20, which can be a greeting card cover, can be housed within an envelope, for example, and/or any other suitable structural enclosure for protecting, moving and/or delivering book 10 and cover 20. In some embodiments, the envelope can be maintained, such as a keepsake, and in other embodiments the envelope can be discarded. Any portion or all of book 10 can fit within or be housed within an envelope or another suitable structure. In some embodiments of this invention, the envelope can have expandable capabilities, such as side gussets or other similar movable and/or returnable structural features. The envelope may or may not have a decorative sealing or closing element, such as an adhesive tape or other suitable securing element.

In some embodiments of this invention, although not shown in the drawings, back 40 also comprises or includes a movable flap 30 that moves in a similar fashion with respect to back 40 rather than cover 20 discussed in the above specification.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

We claim:

1. A greeting card book comprising: a plurality of book pages bound with respect to each other and forming a book, the book pages movable with respect to each other, a greeting card cover connected to the book, a greeting card formed integral to the greeting card cover and including: a message surface of the greeting card cover, the message surface displaying a message, a flap formed in or on an outer surface of the greeting card book and movable with respect to the greeting card cover, and the flap opening with respect to the greeting card cover to reveal at least a portion of the message surface of the greeting card.

2. The greeting card book according to claim 1, wherein the book pages open with respect to each other to show content on the different book pages.

3. The greeting card book according to claim 1, wherein with the flap secured with respect to the cover at least a portion of the message on the message surface is hidden from outer view.

4. The greeting card book according to claim 1, wherein the greeting card cover is connected or integrated together with the book as an outermost front surface.

5. The greeting card book according to claim 1, wherein the message surface has a face surface that accepts or accommodates a written text or an applied message or a signal.

6. The greeting card book according to claim 1, wherein the greeting card is permanently attached to the book as a front cover.

7. The greeting card book according to claim 1, wherein a hinge attaches the flap with respect to the greeting card cover, and the hinge is disposed along a side of the flap disposed toward and parallel to a spine of the book.

8. The greeting card book according to claim 1, further comprising a magnet securing the flap with respect to the greeting card cover.

9. The greeting card book according to claim 1, wherein an adhesive material secures the flap with respect to the greeting card cover.

10. The greeting card book according to claim 1, wherein a channel is formed by a cut between the flap and the greeting card cover.

11. The greeting card book according to claim 10, wherein at least a portion of the channel has a relatively small dimension to form an interference fit between the flap and the greeting card cover.

12. The greeting card book according to claim 1, further comprising a second greeting card cover connected to the book.

13. The greeting card book according to claim 1, wherein the plurality of pages are bound to and between a front cover and a back cover, and the front cover comprises the greeting card cover and the flap is formed in a front outer surface of the front cover.

14. A greeting card book comprising: at least one book page forming a book, a greeting card cover permanently connected to or integrated with the book as an outer front surface of the greeting card book, the at least one book page movable with respect to the greeting card cover, a message surface of the greeting card cover displaying a message, a greeting card formed integral to the greeting card cover and including a flap formed in or on the outer front surface of the greeting card book and movable with respect to the greeting card cover, the flap opening with respect to the greeting card cover to reveal at least a portion of the message surface of the greeting card, a hinge attaching the flap with respect to the greeting card cover, a channel formed by a cut between the flap and the greeting card cover, and at least a portion of the channel having a dimension forming an interference fit between the flap and the greeting card cover.

15. The greeting card book according to claim 14, further comprising a magnet securing the flap with respect to the greeting card cover.

16. The greeting card book according to claim 14, wherein an adhesive material secures the flap with respect to the greeting card cover.

17. In a book having a cover and at least one book page forming a book, the improvement comprising: a greeting card cover integral with a front surface of the cover of the book, the at least one book page movable with respect to the greeting card cover, a greeting card formed integral to the greeting card cover and including a message surface of the greeting card cover displaying a message, a flap movable with respect to the greeting card cover, and the flap opening with respect to the greeting card cover to reveal at least a portion of the message surface of the greeting card.

18. In the book according to claim 17, wherein a hinge attaches the flap with respect to a front surface of the greeting card cover, a channel is formed by a cut between the flap and the greeting card cover, and at least a portion of the channel has a dimension forming an interference fit between the flap and the greeting card cover.

19. In the book according to claim 17, further comprising a magnet securing the flap with respect to the greeting card cover.

20. In the book according to claim 17, wherein an adhesive material secures the flap with respect to the greeting card cover.

* * * * *